US011717736B2

(12) United States Patent
Imoto

(10) Patent No.: US 11,717,736 B2
(45) Date of Patent: Aug. 8, 2023

(54) GOLF TRAINING APPARATUS

(71) Applicant: Mitsuru Imoto, Tokyo (JP)

(72) Inventor: Mitsuru Imoto, Tokyo (JP)

( * ) Notice: Subject to any disclaimer, the term of this patent is extended or adjusted under 35 U.S.C. 154(b) by 0 days.

(21) Appl. No.: 17/659,025

(22) Filed: Apr. 13, 2022

(65) Prior Publication Data

US 2022/0331678 A1 Oct. 20, 2022

(30) Foreign Application Priority Data

Apr. 16, 2021 (JP) ..... 2021-069399

(51) Int. Cl.
*A63B 69/36* (2006.01)

(52) U.S. Cl.
CPC ..... *A63B 69/3608* (2013.01); *A63B 69/3621* (2020.08)

(58) Field of Classification Search
CPC ..... A63B 69/3608; A63B 69/3621; A63B 21/4009; A63B 2071/0633; A63B 71/0622; A63B 15/00; A63B 2071/0655
USPC ..... 473/212, 215, 221, 226, 229, 266, 219
See application file for complete search history.

(56) References Cited

U.S. PATENT DOCUMENTS 11,065,522 B1 * 7/2021 Begley ..... A63B 69/0059
2005/0049068 A1 * 3/2005 Chang ..... A63B 69/3608 473/276
2005/0288121 A1 * 12/2005 Roberts ..... A63B 69/3608 473/276
2008/0153615 A1 * 6/2008 Baird ..... A63B 69/3608 473/207
2012/0184388 A1 * 7/2012 Clark ..... A63B 69/3608 473/409

FOREIGN PATENT DOCUMENTS

EP 3326474 A1 * 5/2018 ..... A41D 1/04

* cited by examiner

*Primary Examiner* — Nini F Legesse

(74) *Attorney, Agent, or Firm* — Plumsea Law Group, LLC

(57) ABSTRACT

Provided is a golf training apparatus that helps a golfer learn a swing with trunk rotation and limited excessive arm movement, which includes an attachment member configured to be detachably attached to a pants belt loop on the front and right side of a user's waist, a case to which the attachment member is fixed, and first and second pads attached to the case via first and second string-like members, respectively. A force in a direction of winding up the first string-like member inside the case is constantly applied on the first string-like member, and the same applies to the second string-like member. The user executes a practice swing with the first and second pad sandwiched under the armpits. If the user opens an armpit, the first or second pad is pulled by the first or second string-like member and then returns to a region near the case.

18 Claims, 10 Drawing Sheets

GOLF TRAINING APPARATUS

CROSS-REFERENCE TO RELATED APPLICATION

The application claims priority from Japanese Patent Application No. 2021-069399 filed Apr. 16, 2021, the disclosure of which is incorporated herein by reference in its entirety.

TECHNICAL FIELD

The present document relates to a golf training apparatus and particularly relates to a golf training apparatus that helps teach the correct form when swinging a golf club.

BACKGROUND ART

Golf is popular all around the world. People watch professional golfers play golf, but there are also many amateur golfers who play golf themselves.

To many golfers, lowering a score is ultimate dream and goal. However, a necessary step before that dream is the goal of increasing the flight distance and improving shot accuracy. Thus, many golfers work hard to learn the correct form used when swinging a golf club.

In response to this strong desire from many golfers, various golf training apparatus providing aid have been proposed, with many being publicly known or well known.

SUMMARY

Technical Problem

There are many golf swing theories, most swing theories put emphasis on the rotation of the trunk of the body. Being able to execute a smooth trunk rotation, also called body turn or the like, allows the golfer to swing the golf club while limiting excessive arm movement during the swing. By executing a smooth trunk rotation and limiting excessive arm movement, the speed and accuracy of the swing can be improved and an increase in flight distance and shot accuracy can be achieved.

However, it is not easy for a golfer to learn to how to swing with both trunk rotation and limited excessive arm movement. A training method for learning such a swing form includes a known method of repeating half-swing shots while keeping a towel with both ends tucked under both armpits from falling. However, there are few golf training apparatus that help increase the effectiveness of such a training method. Further, even in the case of such golf training apparatus existing, such known golf training apparatus may assist in the golfer learning a swing such as that described above by practicing via repetition, but it may be difficult for the golfer practicing via repetition to intuitively determine whether or not each swing is an ideal swing. This is also the case for the training method using a towel described above.

The present embodiments have an object to provide a golf training apparatus that helps a golfer learn a swing with both trunk rotation and limited excessive arm movement and allows a practicing golfer (user of the golf training apparatus) to intuitively determine whether or not each swing is an ideal swing.

Solution to Problem

In order to solve the problems described above, the inventor of the present application proposes the following embodiments.

According to embodiments of the present application, there is provided a golf training apparatus including: an attachment member configured to be detachably attached to a front side of a waist of a user; a case to which the attachment member is attached; a first string-like member including a base end housed in the case, the first string-like member having a wind-up force in a direction toward the base end constantly applied thereto from a first winding mechanism provided in the case and being configured to be pulled out from the case against the force from the first winding mechanism; a first pad which is a plate-like body provided on a distal end of the first string-like member, the first pad having a size and shape that enables a user to sandwich the first pad under one armpit; a second string-like member including a base end housed in the case, the second string-like member having a wind-up force in a direction toward the base end constantly applied thereto from a second winding mechanism provided in the case and being configured to be pulled out from the case against the force from the second winding mechanism; and a second pad which is a plate-like body provided on a distal end of the second string-like member, the second pad having a size and shape that enables a user to sandwich the second pad under another armpit.

The golf training apparatus includes the case to which the attachment member is attached. The attachment member is configured to be attached to the front side of the waist of the user. The first string-like member and the second string-like member are housed in the case. The first string-like member and the second string-like member are configured to be able to pulled out from the case and to have a wind-up force in a direction toward the base end constantly applied thereto from the first winding mechanism or the second winding mechanism. The plate-like first pad is attached to the distal end of the first string-like member, and the plate-like second pad is attached to the distal end of the second string-like member. The first pad and the second pad have a size and shape that enables a user to sandwich under one or another armpit.

The golf training apparatus is used with the case attached to the front side of the waist of the user via the attachment member. The user pulls upward the first pad attached to the distal end of the first string-like member (at this time, the first string-like member is pulled out from the case) against the force of winding up the first string-like member applied to the first string-like member from the first winding mechanism and sandwiches the first pad under the one armpit. Further, the user pulls upward the second pad attached to the distal end of the second string-like member (at this time, the second string-like member is pulled out from the case) against the force of winding up the second string-like member applied to the second string-like member from the second winding mechanism and sandwiches the second pad under the another armpit.

The first pad or the second pad may be sandwiched under the right armpit or under the left armpit. For example, by ensuring a positional relationship such that the first string-like member and the second string-like member do not intersect and sandwiching the first pad and the second pad under the one right armpit and the another left armpit, trouble such as the first string-like member and the second string-like member intersecting and tangling can be avoided.

In the description below, the first pad is sandwiched under the right armpit, and the second pad is sandwiched under the left armpit, but no such limitation is intended.

Under this state, the user grips a golf club and executes a practice swing, for example. Instead of a golf club, a grip training device (a device including a component corresponding to a shaft having a length of approximately from 10 cm to 15 cm attached to a grip portion of a golf club, many such devices being an integrally formed resin molded product or including a metal bar therein) may be gripped and a practice swing may be executed, or the user may grip nothing and execute a practice swing with just the user's hands. A practice swing is executed as follows, for example. In this example, the user is right-handed.

First, the user grips the golf club, leans forward, and takes stance (addresses the ball). At this time, the right armpit and the left armpit of the user are closed.

Next, the takeaway is started.

The user, under this state, keeping the right armpit and the left armpit closed, twists the user's right hip 45° ("45°" used here means "ideally 45°" and actually means "approximately 45°", with this also applying to other instances, such as a joint twisting "45°" or rotating "45°") and then the upper body 45° to the right, so that ultimately the upper body faces the opposite direction to the flight direction of the ball. At this time, ideally, the shaft of the golf club points in the opposite direction to the flight direction of the ball and is roughly horizontal.

From this state, the user raises both hands straight upward, allowing the user to take the top posture with the face of the golf club remaining in a square state. Up until just before taking the top posture, the user is in a state with the right armpit and the left armpit closed. Then, the user begins to raise the user's right arm and open the right armpit at the stage before taking the top posture. This makes the first pad sandwiched under the right armpit be released from under the right armpit. On the first string-like member with the distal end to which the first pad is attached, a wind-up force in the direction of the base end is constantly applied by the first winding mechanism. Thus, when the first string-like member is wound up by the first winding mechanism, the first pad moves to a position near the case. By sensing that the first pad has moved in this manner, the user can determine that the user keeps the correct form in terms of closing under the right armpit until just before taking the top posture, that is, a form where the arm is not excessively used. Further, the fact that the user made the top posture with the golf club raised without excessively using the user's arm means that it can be determined that there is a proper trunk rotation.

The user having taken the top posture now continues and starts the downswing.

When the downswing is executed, while bringing back the right hip and the upper body, leading with the left arm, the right elbow is tucked downward or pulled down quickly, and with the left hip twisted at 45°, an imaginary ball is hit. And the user directs gradually the shaft of the golf club in the flight direction of the ball. At this time, under the left armpit is still closed.

Then, from this state, the user executes the follow through action.

With the follow through, the user twists the upper body a further 45° in the left direction, making the upper body face the flight direction of the imaginary ball and the left arm rise up. At this time, under the left armpit is opened. The user finishes in the finish posture with the upper arm portion of the left arm being roughly horizontal. Thus, just before ending in the finish posture, the second pad that is sandwiched under the left armpit is released from under the left armpit. On the second string-like member with the distal end to which the second pad is attached, a wind-up force in the direction of the base end is constantly applied by the second winding mechanism. Thus, when the second string-like member is wound up by the second winding mechanism, the second pad moves to a position near the case. By sensing that the second pad has moved in this manner, the user can determine that the user keeps the correct form in terms of closing under the left armpit until just before taking the finish posture, that is, a form where the arm is not excessively used. Further, the fact that the user made the finish posture without excessively using the user's arm means that it can be determined that there is a proper trunk rotation.

In this manner, by using the golf training apparatus according to embodiments of the present application, the user can sense the timing of when the first pad is released from under the right armpit and moves to a position near the case and the timing of when the second pad is released from under the left armpit and moves to a position near the case. Thus, the user can intuitively determine whether or not the timing for opening under the right armpit and the timing for opening under the left armpit in the practice swing (or swing) just executed is correct.

Accordingly, in a case in which the user is a beginner golfer, the user can determine whether or not each practice swing corresponds to the correct form or whether the user's form is close to the correct form via the timing of when, during the practice swing, the first pad is released from under the right armpit and moves to a position near the case and the timing of when, during the practice swing, the second pad is released from under the left armpit and moves to a position near the case. Thus, the user that repeatedly trains by executing practice swings using the golf training apparatus can perform this repeated training while confirming whether or not the user's practice swing is getting closer to the correct form. This helps the user easily improve the user's golfing skill.

Further, regardless of whether or not the user is a beginner, by using the golf training apparatus to execute practice swings, the user can determine whether or not the user's current practice swing corresponds to the correct form. This means that in one aspect, the golf training apparatus according to embodiments of the present application is a training apparatus for improving golfing skill, and in another aspect, the golf training apparatus is a practice-swing-proper-form confirmation apparatus for confirming the correctness of the form of the current practice swing.

In addition, most golf training apparatus in the related art are mainly designed to be used at a golf practice range or at home. However, the golf training apparatus of embodiments of the present application can be worn at the front of the waist and used when playing a round of golf at a golf course. Further, during a round, by executing a practice swing with the first pad and the second pad sandwiched under the one right armpit and the another left armpit, the user can confirm whether or not the current practice swing corresponds to the correct form. If the user wants to, the user can also actually hit a ball, not just a practice swing, with the first pad and the second pad sandwiched under the one right armpit and the another left armpit. This allows the user to confirm whether or not the user is swinging properly during a round.

The detailed size and shape of the first pad and the second pad is discretionary, and it is only required that they can be sandwiched under the right armpit and the left armpit. For example, the first pad and the second pad may each include one surface that is a convex surface. Accordingly, when the first pad and the second pad are sandwiched under the right armpit and the left armpit, the convex surface, that is, one surface of the first pad and the second pad, can be placed snuggly against the recessed portion under the right armpit or the left armpit. Thus, in a case in which the first pad and the second pad are sandwiched under the right armpit and the left armpit, the user tends not to feel discomfort and it is easier to prevent the first pad and the second pad from falling out from under the right armpit or the left armpit at an unintended timing such as when the under the right armpit or the left armpit is not open.

The first pad and the second pad may be made of an elastic material. Examples of elastic material include synthetic rubbers such as silicone rubber and natural rubber. With the first pad and the second pad being made of an elastic material, the user tends not to feel discomfort when the first pad and the second pad are sandwiched under the right armpit and the left armpit and the frictional resistance between the first pad and the second pad and the shirt or coat worn by the user can be increased. This helps prevent the first pad and the second pad from falling out from under the right armpit and the left armpit at an unintended timing when under the right armpit or under the left armpit is not open.

The first pad and the second pad may each have a shape on a distal end side that is tapered and rounded. In a case in which the first pad and the second pad have such a shape, the tapered and rounded portion is easily put under the right armpit or the left armpit. Further, in a case in which the distal end is rounded, the user tends not to feel discomfort when the first pad and the second pad are sandwiched under the right armpit and the left armpit. For example, the first pad may have a roughly triangular shape with the farthest vertex from the connection portion of the first pad with the first string-like member being an acute angle and all of the vertices being rounded, and the second pad may have a roughly triangular shape with the farthest vertex from the connection portion of the second pad with the second string-like member being an acute angle and all of the vertices being rounded.

The first pad and the second pad may be opaque, may be colored and transparent or colored and semitransparent, or may be colorless and transparent or colorless and semitransparent. In a case in which the first pad and the second pad are colorless and transparent or colorless and semitransparent, the first pad and the second pad, which have the highest likelihood of standing out from among the parts of the golf training apparatus, can be made not to stand out. Because the first pad and the second pad do not stand out, this has the advantage that, particularly in a case in which the golf training apparatus is used at a place where there are other people such as at a golf course, the coordinated outfit worn by the user is not compromised.

The attachment member is configured to detachably attached to the front side of the waist of the user as described above. For example, the attachment member is configured to be detachably attached to the portion of the garment of the user corresponding to the front side of the waist.

The detachable attachment may be achieved by using a safety pin, for example. Further, the attachment member may be configured to be detachably attached to a belt loop of pants worn by the user. As a matter of course, the attachment member that is able to be detachably attached to the belt loop of a pair of pants can also be detachably attached to the belt loop of culottes, a skirt, and the like. As a matter of course, the requirement that the attachment member is configured to be detachably attached to a belt loop of pants worn by a user is also satisfied in such usage cases. The belt loop has a loop shape. Thus, as an example of the attachment member that is detachably attached to the belt loop, there can be given a hook-shaped member capable of catching on the belt loop. Further, a carabiner may be used as the attachment member to prevent the attachment member from falling off the belt loop.

When the attachment member is configured to be detachably attached to a belt loop of pants worn by a user, the following advantages can be obtained. Of the belt loops on the pants, the belt loop located on the front and right side is roughly located on the front and right side as seen from the trunk (in a plan view, a position rotated approximately 45° to the right from the front of the trunk). When the user with the case of the golf training apparatus of embodiments of the present application attached at this position executes a practice swing, as described above, first, the right hip is twisted 45° to the right with the right armpit and the left armpit closed. In a case in which the golf training apparatus is attached at the position described above, under a state in which the upper body is twisted 45°, the case of the golf training apparatus is positioned in the opposite direction of the trunk to the flight direction of the ball. Thus, by using the user's peripheral vision, for example, to see that the case has come to the opposite side of the trunk to the flight direction of the ball, the user can confirm whether or not the action of the initial stages of the swing of the golf club is correct. This effect is not limited to a case in which the attachment member is attached to a belt loop on the front and right side and can also be obtained by the attachment member attached at the same position. In a case in which the attachment member is configured to be detachably attached to a belt loop, by the attachment member attached to a belt loop located on the front and right side, the effect described above can be easily and reliably obtained.

The case may include a first opening provided in the case for the first string-like member to pass through the case and a second opening provided in the case for the second string-like member to pass through the case. The first opening and the second opening and the attachment member may be located at positions on opposite sides of the case.

As described above, the case of the golf training apparatus of embodiments of the present application is attached on the front of the waist of the user. In a case in which the attachment member is for example a carabiner and is attached to a belt loop of the pants, the case hangs down below the attachment member when the first pad and the second pad are not in the process of being sandwiched under the right armpit and the left armpit, although this depends on the attachment member and the attachment method of the case on the front of the waist of the user. When the first pad and the second pad are in the process of being sandwiched under the right armpit and the left armpit, an upward pulling force is applied on the case from the first string-like member and the second string-like member. Thus, the state of the case and the attachment member is inverted (put upside down) so that the case is located on the upper side and the attachment member attached to the belt loop of the pants is located on the lower side. At this time, the first string-like member and the second string-like member extend upward. Thus, because the attachment member and the first opening and the second opening are located on opposite sides of the case and the first opening and the second opening open upward, the first string-like member and the second string-like member can be smoothly pulled out from the case.

This is not limited to a case in which the attachment member is a carabiner attached to the belt loop of the pants and also typically applies to cases in which the attachment member is attached to the garment or the like of the user with the case being able to be inverted in terms of up and down.

As described above, by using the golf training apparatus according to embodiments of the present application, the user can sense the timing of when the first pad is released from under the right armpit and moves to a position near the case and the timing of when the second pad is released from under the left armpit and moves to a position near the case. Thus, the user can intuitively determine whether or not the form of the practice swing just executed is correct.

Accordingly, the user can accurately sense the timing of when the first pad is released from under the right armpit and moves to a position near the case and the timing of when the second pad is released from under the left armpit and moves to a position near the case. Thus, the user can more accurately determine whether or not the form of the practice swing just executed is correct.

In view of such points, for the golf training apparatus according to embodiments of the present application, it is preferred that noise perceivable by the user be generated when the first string-like member is wound up by the first winding mechanism and when the second string-like member is wound up by the second winding mechanism. With this configuration, the noise generated when the first string-like member is wound up by the first winding mechanism and when the second string-like member is wound up by the second winding mechanism is heard by the user, allowing the user to accurately grasp the timing of when the first pad is released from under the right armpit and moves to a position near the case and the timing of when the second pad is released from under the left armpit and moves to a position near the case. Further, because this can be grasped by hearing, the user does not need to look away from the ball (imaginary ball). This stabilizes the form of the practice swing and helps make the form of the practice swing correspond to an actual swing with a golf club.

DESCRIPTION OF EMBODIMENTS

Embodiments are now described below with reference to the drawings.

Figure 1:
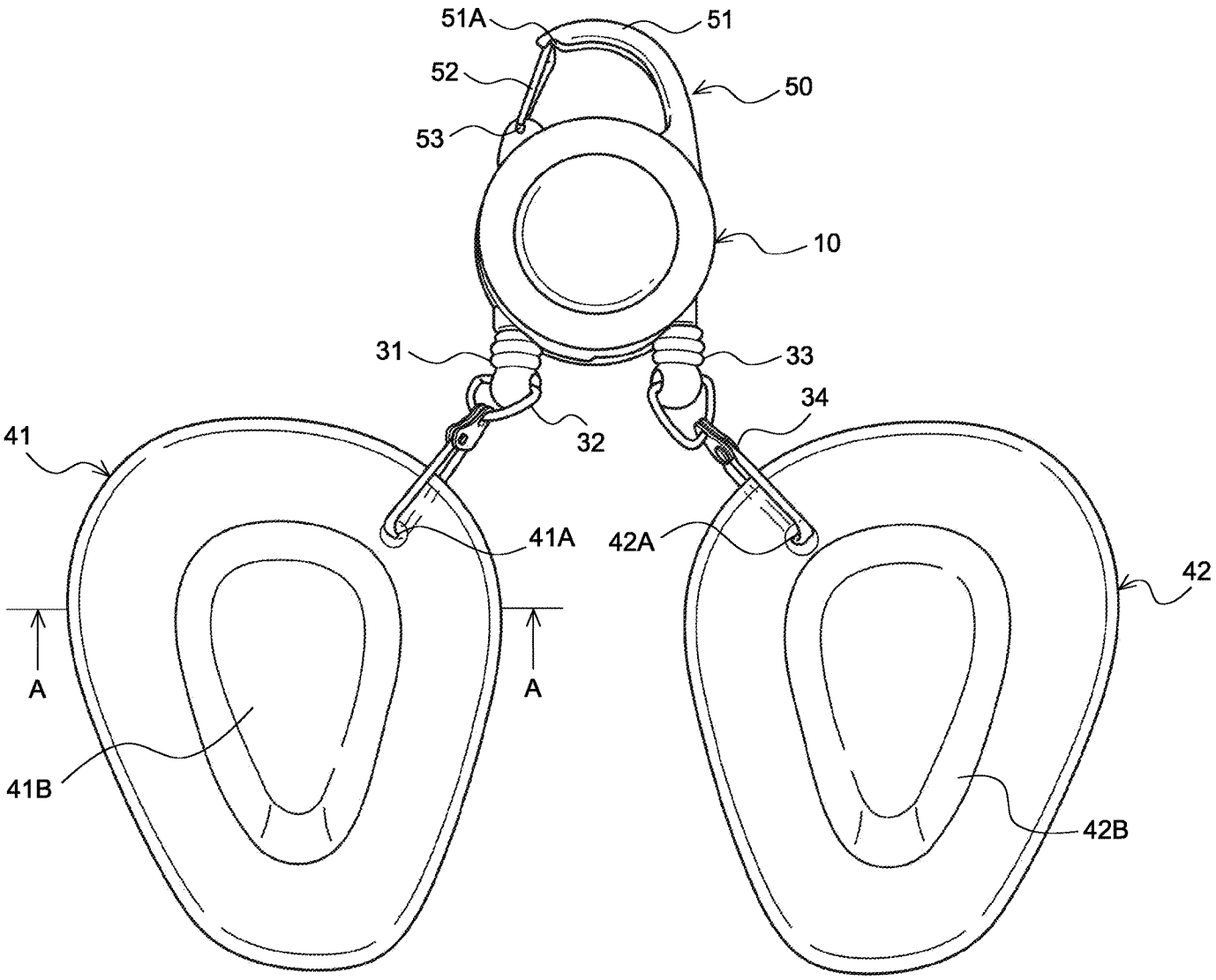
FIG. 1 is a front view for illustrating the overall configuration of a golf training apparatus according to an embodiment.

FIG. 1 is a front view of a golf training apparatus of this embodiment.

The golf training apparatus includes a case 10. The case 10 is configured to house a first winding mechanism and a second winding mechanism described later. Basically, any size and shape of the case 10 may be employed as long as the case 10 can house the first winding mechanism and the second winding mechanism. However, because the user executes a swing or practice swing with a golf club while the case 10 is attached to the front of the waist of the user via a function of an attachment member described below, the case 10 needs to be small enough to not interfere with the action of swinging and practice swinging. Further, for the same reason, it is preferred that the weight of the case 10, including the built-in components, be as light as possible. As described below, in the case of the user playing a round at a golf course while wearing the golf training apparatus, it is clearly preferred that the overall weight of the golf training apparatus be light.

The case 10 of this embodiment has a thin cylindrical shape with a thickness (in the depth direction of FIG. 1) ranging from approximately 1 cm to 2 cm and a diameter ranging from 3 cm to 5 cm. However, no such limitation is intended. Further, the material is a resin or metal, but no such limitation is intended.

The case 10 is hollow, and the first winding mechanism and the second winding mechanism are provided inside the case 10. The first winding mechanism is configured to constantly apply a force on a first string-like member in the wind-up direction, and the second winding mechanism is configured to constantly apply a force on a second string-like member in the wind-up direction. Further, the first string-like member is able to be pulled out from the first winding mechanism or the case 10 by pulling against the force applied by the first winding mechanism. In a similar manner, the second string-like member is able to be pulled out from the second winding mechanism or the case 10 by pulling against the force applied by the second winding mechanism. The first winding mechanism and the second winding mechanism configured to implement such a function may be mechanisms long used in tape measures and the like that are publicly known and also well known.

The first string-like member and the first winding mechanism and the second string-like member and the second winding mechanism may have a similar configuration. Accordingly, only the principles of the second winding mechanism will be simply described.

Figure 2:
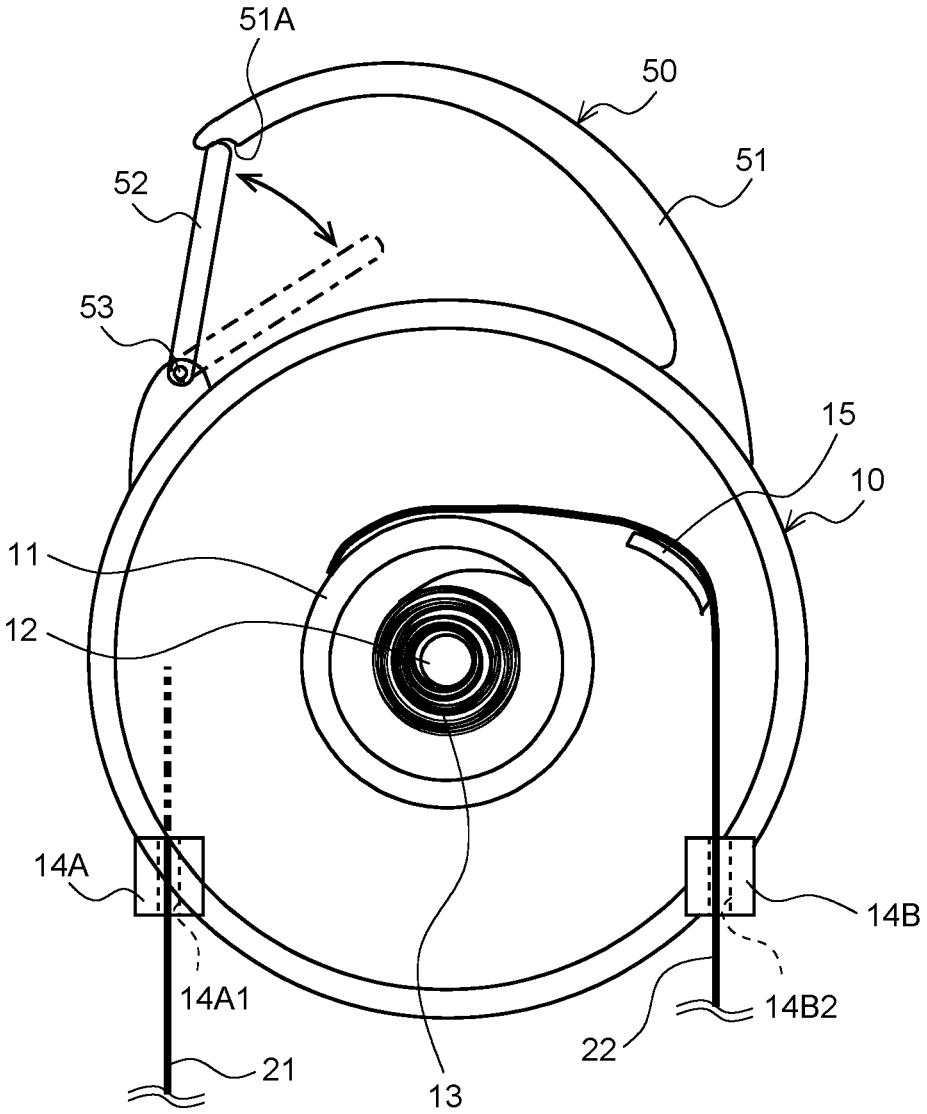
FIG. 2 is a front sectional view for schematically illustrating the structure inside a case of the golf training apparatus illustrated in FIG. 1.

FIG. 2 is a view of a simplified structure of the inside of the case 10. In FIG. 2, the second string-like member is denoted by 22. In FIG. 2, the second string-like member 22 has been pulled out to its maximum length.

A thin cylindrical drum 11 is housed in the case 10. The drum 11 is rotatably supported on a cylindrical center shaft 12 that extends in the thickness direction of the case 10 from an inner surface of the case 10 to an inner surface of the case 10, for example. The base end of the second string-like member 22 is fixed at an appropriate position on the side surface of the drum 11. When the second string-like member 22 is wound up, the second string-like member 22 is wound around the drum 11.

A flat coil spring 13 is disposed on the inner side of the drum 11. The flat coil spring 13 is connected at one end to the center shaft 12 and connected at another end to the inner side of the drum 11. The flat coil spring 13 is an elongated plate spring wound up in a coil shape that is publicly known or well known. By pulling out the second string-like member 22 and rotating the drum 11, the flat coil spring 13 is gradually tightened. In FIG. 2, the flat coil spring 13 is in a state of maximum tension. The tightened flat coil spring 13 constantly applies a force to return to its original state. Thus, on the second string-like member 22, a force is constantly applied to wind up the second string-like member 22 on the drum 11 inside the case 10. In this embodiment, even when the second string-like member 22 is not pulled out from the case 10 at all, the flat coil spring 13 is still in a state of being slightly tightened. Thus, from the point in time when the second string-like member 22 is pulled out from the case 10, a force is applied to the second string-like member 22 in the wind-up direction toward the base end.

On the lower side of the outer circumference of the case 10 in FIG. 1 and FIG. 2, a second cylindrical member 14B with a cylindrical shape including a hole 14B2 for guiding the second string-like member 22 outside the case 10 is attached. The second string-like member 22 runs inside and outside the case 10 via the hole 14B2 on the inner side of the second cylindrical member 14B. The hole 14B2 provided in the second cylindrical member 14B determines the advancement direction of the second string-like member 22 and has the function of guiding the second string-like member 22 as it runs out from the case 10.

Though not necessary, inside the case 10 of this embodiment, a guide portion 15 with a smooth curved surface on the outer side is provided for guiding the second string-like member 22 between the hole 14B2 of the second cylindrical member 14B and the drum 11 and changing the orientation of the second string-like member 22. For example, the guide portion 15 is provided on the inner surface of the case 10, but is not limited thereto.

From among the drum 11, the center shaft 12, the flat coil spring 13, the second cylindrical member 14B, and the guide portion 15, a combination of at least the drum 11, the center shaft 12, and the flat coil spring 13 corresponds to the second winding mechanism of the present application.

In this embodiment, the second winding mechanism and the first winding mechanism are disposed overlapping one another in the thickness direction of the case 10. A dividing plate (not shown) for separating the first winding mechanism and the second winding mechanism is provided between the first winding mechanism and the second winding mechanism. The first winding mechanism and the second winding mechanism may basically be identical, and the first winding mechanism, as with the second winding mechanism, may include the drum 11, the center shaft 12, the flat coil spring 13, a first cylindrical member 14A corresponding to the second cylindrical member 14B, and the guide portion 15. The first winding mechanism may have a mirror image relationship with the second winding mechanism illustrated in FIG. 2, and this is true for this embodiment.

In FIG. 2, only a first string-like member 21 and the first cylindrical member 14A including a hole 14A1 through which the first string-like member 21 passes are illustrated.

Now, FIG. 1 is referred again.

A connection member 31 with a significantly larger diameter than the hole 14A1 to prevent it from entering the hole 14A1 of the first cylindrical member 14A and a connection fitting 32 attached to the distal end of the connection member 31 are attached to the distal end of the first string-like member 21. Further, a first pad 41, which is a plate-like body, is attached to the connection fitting 32. In this embodiment, the first pad 41 and the first string-like member 21 are connected by passing the annular connection fitting 32 through a hole 41A provided in the first pad 41. However, the connection method is not limited thereto, and it is only required that the first pad 41 and the first string-like member 21 be connected. Further, for example, the first pad 41 may be directly connected to the distal end of the first string-like member 21.

In a similar manner, a connection member 33 with a significantly larger diameter than the hole 14B2 to prevent it from entering the hole 14B2 of the second cylindrical member 14B and a connection fitting 34 attached to the distal end of the connection member 33 are attached to the distal end of the second string-like member 22. Further, a second pad 42, which is a plate-like body, is attached to the connection fitting 34. In this embodiment, the second pad 42 and the second string-like member 22 are connected by passing the annular connection fitting 34 through a hole 42A provided in the second pad 42. However, in a similar manner to the first pad 41 and the first string-like member 21, the connection method is not limited thereto, and it is only required that the second pad 42 and the second string-like member 22 be connected. Further, for example, the second pad 42 may be directly connected to the distal end of the second string-like member 22. In this embodiment, the connection member 31 and the connection member 33 and the connection fitting and the connection fitting 34 are identical, but no such limitation is intended.

The first string-like member 21 and the second string-like member 22 are both string-like members. Though a certain toughness is required, because the first string-like member 21 and the second string-like member 22 come into contact with the body of the user, it is preferred that the first string-like member 21 and the second string-like member 22 be as flexible as possible. For example, a thread made of woven polyethylene resin fibers, a nylon thread similar to that used in fishing line, and the like can be used for the first string-like member 21 and the second string-like member 22. In this embodiment, the first string-like member 21 and the second string-like member 22 are made of a nylon thread, but no such limitation is intended.

Further, the first string-like member 21 needs a length such that the first pad 41 attached to the distal end of the first string-like member 21 can be sandwiched under the right armpit or left armpit when the case 10 is attached to the front side of the waist of the user. In a similar manner, the second string-like member 22 needs a length such that the second pad 42 attached to the distal end of the second string-like member 22 can be sandwiched under the right armpit or left armpit when the case 10 is attached to the front side of the waist of the user. Taking this into account, the length required for the first string-like member 21 and the second string-like member 22 depends on the body type of the user, but a length of 50 cm for the portion exposed from the case 10 is sufficient, for example. In the case of a small build, such as a case in which the target user is a female, a length of 30 cm for the first string-like member 21 and the second string-like member 22 exposed from the case 10 is sufficient in most cases. The first string-like member 21 and the second string-like member 22 need not have the same length. However, because there is no reason to have different lengths, in this embodiment, both have the same length, with the length of the portion exposed from the case 10 being 50 cm. However, no such limitation is intended.

The detailed size and shape of the first pad 41 and the second pad 42 is discretionary, and it is only required that they can be sandwiched under the right armpit and the left armpit. They may be identical or may be not identical. In this embodiment, the first pad 41 and the second pad 42 have a mirror image relationship.

The first pad 41 and the second pad 42 are both plate-like bodies. The first pad 41 and the second pad 42 may be made of an elastic material, but are not limited thereto. Examples of elastic material include synthetic rubbers such as silicone rubber and natural rubber. The first pad 41 and the second pad may be colorless and transparent or colorless and semitransparent, but are not limited thereto. Examples of colorless and transparent or colorless and semitransparent elastic bodies include silicone rubber and urethane rubber. In this embodiment, the first pad 41 and the second pad 42 are both made of silicone rubber, which is elastic material and is transparent. However, no such limitation is intended.

In this embodiment, the first pad 41 and the second pad 42 are formed with a tapered and rounded distal end. However, no such limitation is intended. In a case in which the first pad 41 and the second pad 42 have such a shape, the tapered and rounded portion is easily put under the right armpit or the left armpit when the first pad 41 and the second pad 42 are sandwiched under the right armpit and the left armpit. Further, in a case in which the distal end is rounded, the user tends not to feel discomfort when the first pad 41 and the second pad 42 are sandwiched under the right armpit and the left armpit. In this embodiment, the first pad 41 has a roughly triangular shape with the vertex farthest from the connection portion of the first pad 41 with the first string-like member 21 having an acute angle and all of the vertices being rounded. However, no such limitation is intended. The second pad 42 also has a roughly triangular shape with the vertex farthest from the connection portion of the second pad 42 with the second string-like member 22 having an acute angle and all of the vertices being rounded.

Further, the first pad 41 and the second pad 42 of this embodiment both have one surface that is a convex surface. However, no such limitation is intended. Accordingly, when the first pad 41 and the second pad 42 are sandwich under the right armpit and the left armpit, the convex surface, that is, one surface of the first pad 41 and the second pad 42, can be placed snuggly against the recessed portion under the right armpit or the left armpit. Thus, in a case in which the first pad 41 and the second pad 42 are sandwiched under the right armpit and the left armpit, the user tends not to feel discomfort and it is easier to prevent the first pad 41 and the second pad 42 from falling out from under the right armpit or the left armpit at an unintended timing such as when the under the right armpit or the left armpit is not open. Specifically, as illustrated in FIG. 1 and the cross-sectional view of FIG. 3 taken along the line A-A in FIG. 1, a convex portion 41B raised like a hill is provided in a central region of the first pad 41 in an area slightly smaller than the area of the overall shape of the first pad 41. In a similar manner, a convex portion 42B similar to the convex portion 41B is provided in the central region of the second pad 42.

Figure 4:
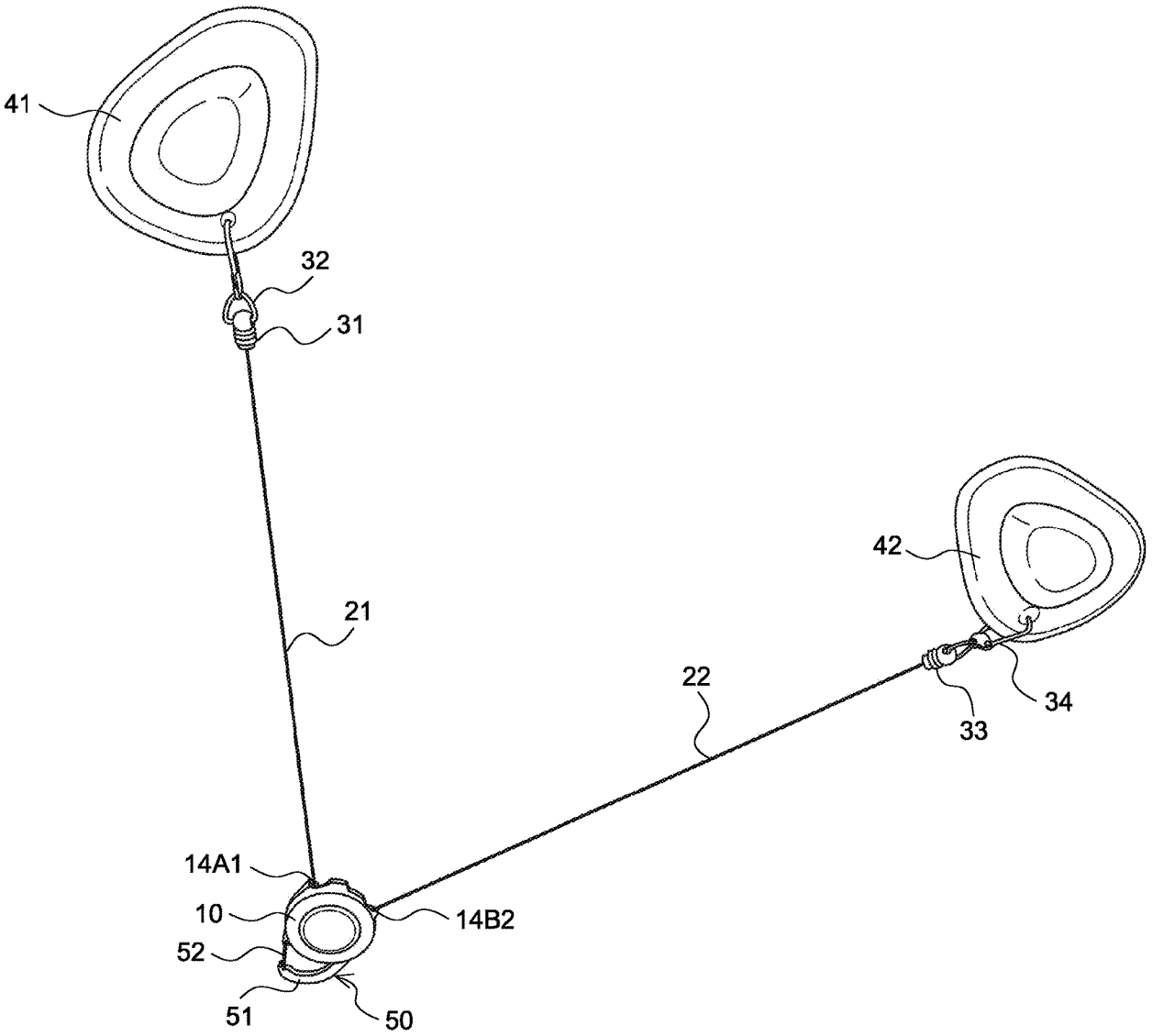
FIG. 4 is a perspective view for illustrating a state in which the first pad and a second pad of the golf training apparatus illustrated in FIG. 1 are separated from the case.

The first pad 41 attached to the distal end of the first string-like member 21 and the second pad 42 attached to the distal end of the second string-like member 22 are able to be separate from the case 10, as illustrated in FIG. 4, by pulling the first pad 41 and the second pad 42 away from the case 10, for example. Even though a force in the direction of winding up the first string-like member 21 and the second string-like member 22 inside the case 10 is applied from the first winding mechanism and the second winding mechanism, by pulling the first pad 41 and the second pad 42 with a force greater than this force, a state such as that illustrated in FIG. 4 can be achieved.

When the force applied to the first pad 41 and the second pad 42 is released, the first string-like member 21 and the second string-like member 22 are wound up inside the case 10, bringing the first pad 41 and the second pad 42 back to a state close to the case 10 such as that illustrated in FIG. 1.

An attachment member 50 is attached above, as illustrated in FIG. 1, the case 10. The attachment member 50 is for detachably attaching the case 10 to a front portion of the waist of the user. Typically, the case 10 or the attachment member 50 is attached to the clothes worn by the user on the front side of the waist of the user. The attachment member 50 may have any configuration, as long as the attachment member 50 or the case 10 can be positioned at the front of the waist of the user by being attached to the garment of the user or the like. In this embodiment, a carabiner is used, but no such limitation is intended.

Carabiners have been publicly known and well known for more than 100 years, and so only a simple description of the configuration will be given. The attachment member 50 formed of a carabiner includes a bowed member 51 shaped like a bow, for example, that extends from the upper right of the case 10 as illustrated in FIG. 1 and FIG. 2 and a movable member 52 with a linear shape but not limited thereto that extends from the upper left of the case 10 as illustrated in FIG. 1 and FIG. 2. The movable member 52 is configured to be able to rotate or swing about a shaft 53 that pivotally supports the lower end of the movable member 52. Specifically, the movable member 52 is configured to be able to swing between a closed position indicated by the solid line in FIG. 2 and an open position indicated by the dot-dash line. When the movable member 52 is in the closed position, the bowed member 51 and the movable member 52 together with the upper portion of the case 10 located between the base ends of the bowed member 51 and the movable member 52 form a space enclosed by an annular member. When the movable member 52 is in the open position, the distal end of the movable member 52 is separated from the distal end of the bowed member 51, thus connecting a portion of the space enclosed by the annular member with the outside.

A force is applied on the movable member 52 to make it swing in a direction from the open position toward the closed position from an elastic body (not shown) (for example, a screw coil spring or other spring) provided near the shaft 53. Accordingly, the movable member 52 can be moved from the closed position to the open position against the force from the elastic body. However, when an external force is not present, the movable member 52 is always located in the closed position. The distal end of the bowed member 51 on the side (lower side in FIG. 1 and FIG. 2) facing the case 10 includes a step 51A that engages with the distal end of the movable member 52. Thus, even though there is a constant force from the elastic body described above on the movable member 52 in the counterclockwise direction in FIG. 1 and FIG. 2 in the direction of returning the movable member 52 to the closed position, the distal end of the movable member 52 never moves to the left side of the distal end of the bowed member 51, as illustrated in FIG. 1 and FIG. 2.

When the movable member 52 is in the open position, something can be inserted into the space enclosed by the annular member described above from the gap between the distal end of the bowed member 51 and the distal end of the movable member 52, but by returning the movable member 52 from this state to the closed position, that something inserted into the space enclosed by the annular member cannot exit the space enclosed by the annular member. In this embodiment, that something inserted into the space enclosed by the annular member is expected to be a belt loop of the pants worn by the user. In other words, in this embodiment, the attachment member 50 is detachably attached to a belt loop of a pair of pants.

Another example of the attachment member 50 is a safety pin. By using a safety pin, the attachment member 50 can be detachably attached to an appropriate portion of the garment of the user. As a matter of course, the attachment member 50 may also be attached on the front side of the waist of the user. The attachment member 50 may be fixed to the case 10 using an appropriate method. It is not always required that the fixing of the two be a fixing method, and the two may be tied together using a cord approximately a few centimeters long, for example.

A plurality of the attachment members 50 may be provided. For example, a carabiner as the attachment member 50 and a safety pin as the attachment member 50 may both be attached to the case 10. In this case, when the user is wearing pants, the carabiner attachment member 50 can be attached to the belt loop of the pants, and when the carabiner attachment member 50 cannot be used, such as when the user is wearing a skirt and not wearing pants or when the pants worn by the user do not have belt loops, for example, the safety pin attachment member 50 can be used. In this manner, a plurality of types of the attachment member 50 can be used as appropriate depending on the situation.

The attachment member 50 is located on the upper side of the case 10 in FIG. 2. Further, the hole 14A1 on the inner side of the first cylindrical member 14A which is a hole provided in the case for the first string-like member 21 to pass through and the hole 14B2 on the inner side of the second cylindrical member 14B which is a hole provided in the case 10 for the second string-like member 22 to pass through are both located on the lower side of the case 10 in FIG. 2, or in other words on the opposite side of the case 10 from the attachment member 50.

The method of use and action of the golf training apparatus described above will now be described.

In the case of using the golf training apparatus, the user attaches the golf training apparatus to the front of the waist of the user. In this embodiment, a right-handed user attaches the golf training apparatus on the front and right side of the waist of the user, but no such limitation is intended. A left-handed user attaches the golf training apparatus on the front and left side of the waist of the user.

The attachment member 50 is used to attach the golf training apparatus on the front and right side of the waist of the user. In this embodiment, the attachment member 50 is formed of a carabiner as described above. The attachment member 50 is detachably attached to a belt loop on the front and right side of the pants worn by the user. As stated above, it is not necessary for a belt loop to be used to attach the attachment member 50.

To attach the attachment member 50, the movable member 52 of the attachment member 50 normally in the closed position is moved to the right side of FIG. 1 and FIG. 2 against the force from the elastic body, moving the movable member 52 to the open position. Then, a gap is formed between the distal end of the bowed member 51 and the distal end of the movable member 52, and a portion of the space enclosed by the annular member formed by the bowed member 51 and the movable member 52 together with the upper portion of the case 10 located between the base ends of the bowed member 51 and the movable member 52 is opened. The belt loop on the front and right side of the pants is inserted from this gap inside the space described above enclosed by the annular member. Further, when the user's hand releases the movable member 52, the distal end of the movable member 52 returns to the closed position and engages with the step 51A on the distal end of the bowed member 51.

Figure 5:
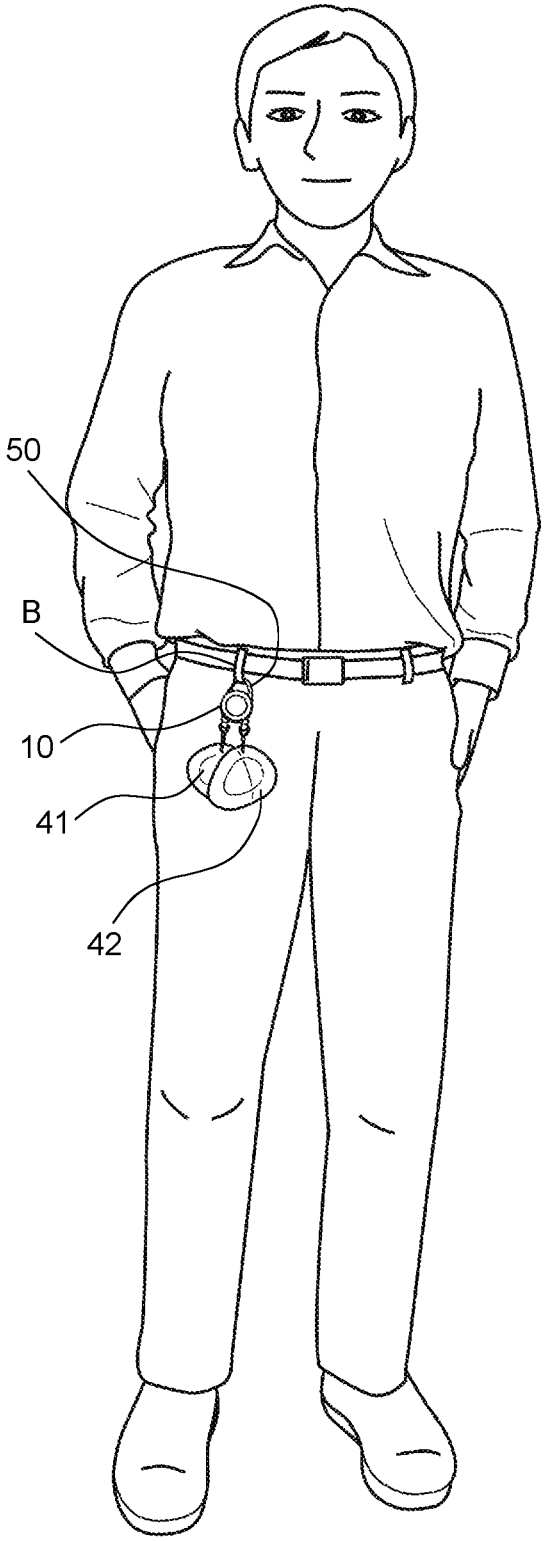
FIG. 5 is a front view for illustrating a state in which the golf training apparatus illustrated in FIG. 1 is attached to a belt loop on the front and right side of the pants worn by a user.

This ends the attachment of the training apparatus to the front and right side of the waist of the user (FIG. 5). The golf training apparatus is attached with a belt loop B on the front and right side of the pants worn by the user passed into the space enclosed by the annular member formed by the bowed member 51 and the movable member 52 together with the upper portion of the case 10 located between the base ends of the bowed member 51 and the movable member 52.

In this manner, the case 10 is suspended below the attachment member 50 detachably attached to the belt loop B on the front and right side of the pants, and the first pad 41 and the second pad 42 are also suspended below the case 10. The positional relationship in terms of left and right of the first pad 41 and the second pad 42 illustrated in FIG. 5 may be reversed.

Of the belt loops B on the pants, the belt loop B located on the front and right side is typically located on the front and right side as seen from the trunk of the user (in a plan view, a position rotated approximately 45° to the right from the front of the trunk).

Figure 6:
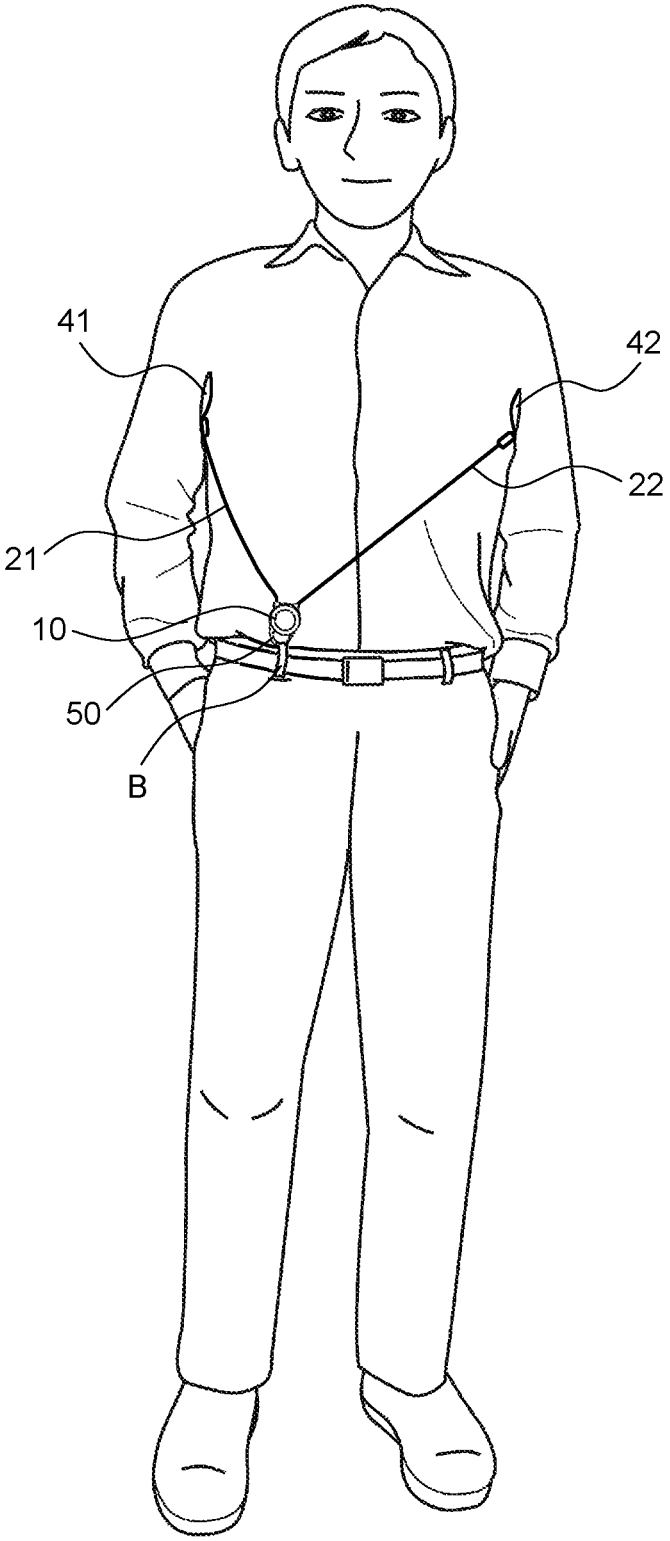
FIG. 6 is a front view for illustrating a state in which the first pad of the golf training apparatus illustrated in FIG. 1 is sandwiched under the right armpit and in which the second pad is sandwiched under the left armpit.

The user executes a practice swing (or may actually hit a ball using a golf club) with the golf training apparatus installed on the belt loop B of the pants. However, before executing a practice swing, the user sandwiches the pad, from among the first pad 41 and the second pad 42, which is placed on the right side in the state illustrated in FIG. 5 (in this example, the first pad 41) under the right armpit and sandwiches the pad on the left side in the state illustrated in FIG. 5 (in this example, the second pad 42) under the left armpit (FIG. 6). The first pad 41 may be sandwiched under the right armpit first, or the second pad 42 may be sandwiched under the left armpit first. At this time, it is preferred that the first string-like member 21 and the second string-like member 22 do not intersect.

To sandwich the first pad 41 under the right armpit, the first pad 41 is pulled upward, pulling the first string-like member 21 out from the case 10 against the force in the direction of winding up the first string-like member 21 applied by the first string-like member 21 on the first string-like member 21. Here, the case 10 is also pulled upward by the force from the first string-like member 21, causing the attachment member 50 attached to the belt loop B of the pants to be positioned down and the case 10 to be positioned up. In other words, the golf training apparatus is put in a state that is upside-down, rotated about the belt loop B of the pants, that of the state illustrated in FIG. 5. At this time, the hole 14A1 on the inner side of the first cylindrical member 14A which is a hole provided in the case 10 for the first string-like member 21 to pass through and the attachment member 50 are on opposite sides of the case 10. Thus, the hole 14A1 is put in a state opening upwards, and the first string-like member 21 can extend upward smoothly from the hole 14A1 provided in the case 10.

Figure 3:
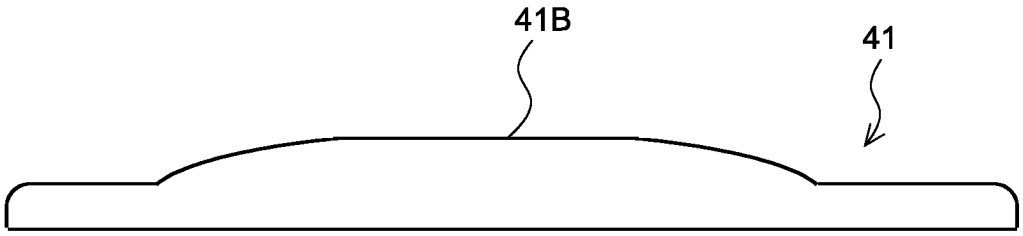
FIG. 3 is a sectional view of a first pad of the golf training apparatus illustrated in FIG. 1 taken along the line A-A of FIG. 1.

When the first pad 41 reaches a position under the right armpit, the user sandwiches the first pad 41 under the right armpit. Here, as illustrated in FIG. 1, the first pad 41 is sandwiched under the right armpit such that the rounded and acute angle vertex of the first pad 41 on the lower side is orientated facing upward, and the convex surface of the convex portion 41B illustrated in FIG. 3 is positioned in the recess on the torso side under the right armpit. A force from the first string-like member 21 in the direction of returning to the case 10 is applied on the first pad 41 sandwiched under the right armpit. However, with the first pad 41 sandwiched tightly under the right armpit, the first pad 41 stays under the right armpit.

In a similar manner, the second pad 42 is then pulled upward, pulling the second string-like member 22 out from the case 10 against the force in the direction of winding the second string-like member 22 applied by the second winding mechanism on the second string-like member 22. At this time, the hole 14B2 on the inner side of the second cylindrical member 14B which is a hole provided in the case 10 for the second string-like member 22 to pass through and the attachment member 50 are on opposite sides of the case 10. Thus, the hole 14B2 is put in a state opening upwards, and the second string-like member 22 can extend upward smoothly from the hole 14B2 provided in the case 10.

When the second pad 42 reaches a position under the left armpit, the user sandwiches the second pad 42 under the left armpit. Here, as illustrated in FIG. 1, the second pad 42 is sandwiched under the left armpit such that the rounded and acute angle vertex of the second pad 42 on the lower side is orientated facing upward, and the convex surface of the convex portion 42B is positioned in the recess on the torso side under the left armpit. A force from the second string-like member 22 in the direction of returning to the case 10 is applied on the second pad 42 sandwiched under the left armpit. However, with the second pad 42 sandwiched tightly under the left armpit, the second pad 42 stays under the left armpit.

The first pad 41 and the second pad 42 are made of elastic bodies and have a shape with the distal end on the side sandwiched under the armpit that is tapered and rounded as described above. Thus, the user tends not to feel discomfort with the first pad 41 and the second pad 42 sandwiched under the armpits. Further, because the first pad 41 and the second pad 42 are transparent, they themselves do not stand out and thus do not clash with the coordinated outfit worn by the user.

Now, the practice swing preparation for the user is complete.

Figure 7:
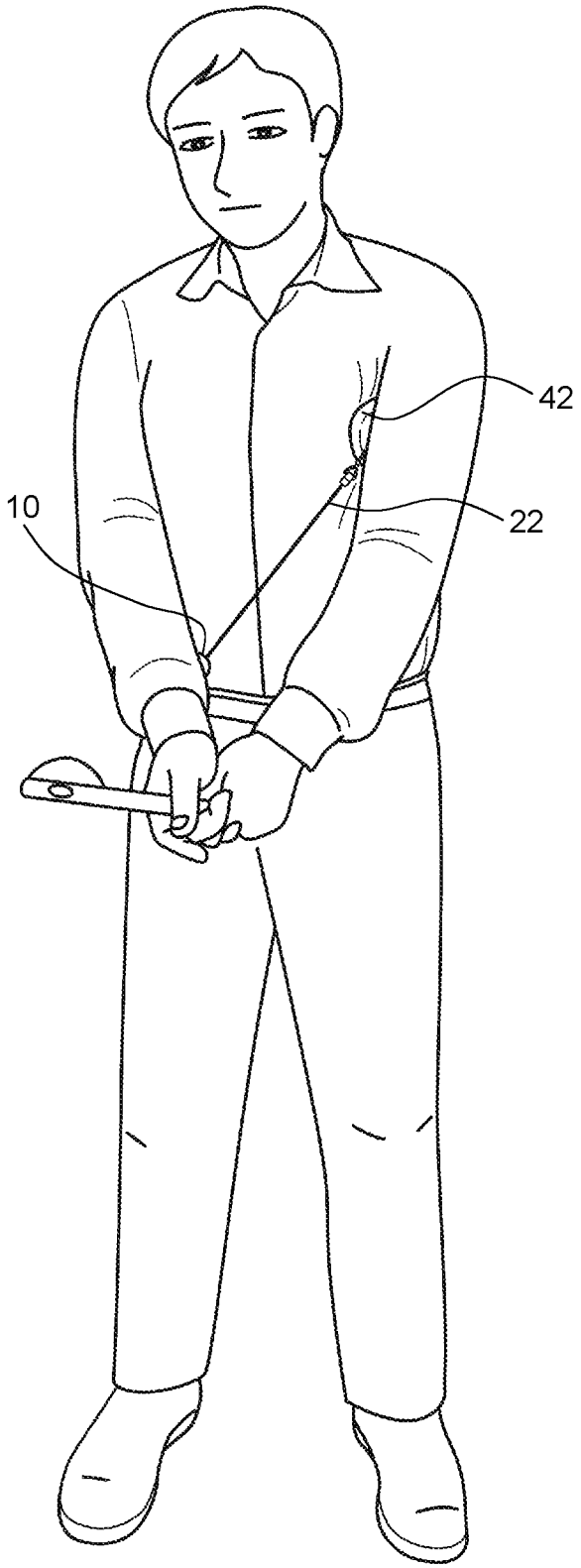
FIG. 7 is a front view for illustrating a state just before taking stance to execute a practice swing using the golf training apparatus illustrated in FIG. 1.

Under this state, the user grips the golf club or the like (or does not grip anything) and takes stance (addresses the ball). FIG. 7 shows the state just before taking stance. Further, in FIG. 7, the user is gripping a commercially available grip training device including a portion simulating the grip of a golf club and a portion ranging from 10 cm to 15 cm simulating a shaft, which are integrally attached together.

The user taking stance grips the grip training device, faces an imaginary ball, stands with feet apart by a distance slightly more than shoulders width, and leans forward. At this time, the right armpit and the left armpit of the user are closed. With the right armpit and the left armpit closed, the first pad 41 stays under the right armpit and the second pad 42 stays under the left armpit. With this, the user can at this stage be aware of the user's state with the user's right armpit and left armpit closed. At this stage, most users will not open up under the right armpit and under the left armpit.

Next, the takeaway is started.

Figure 8:
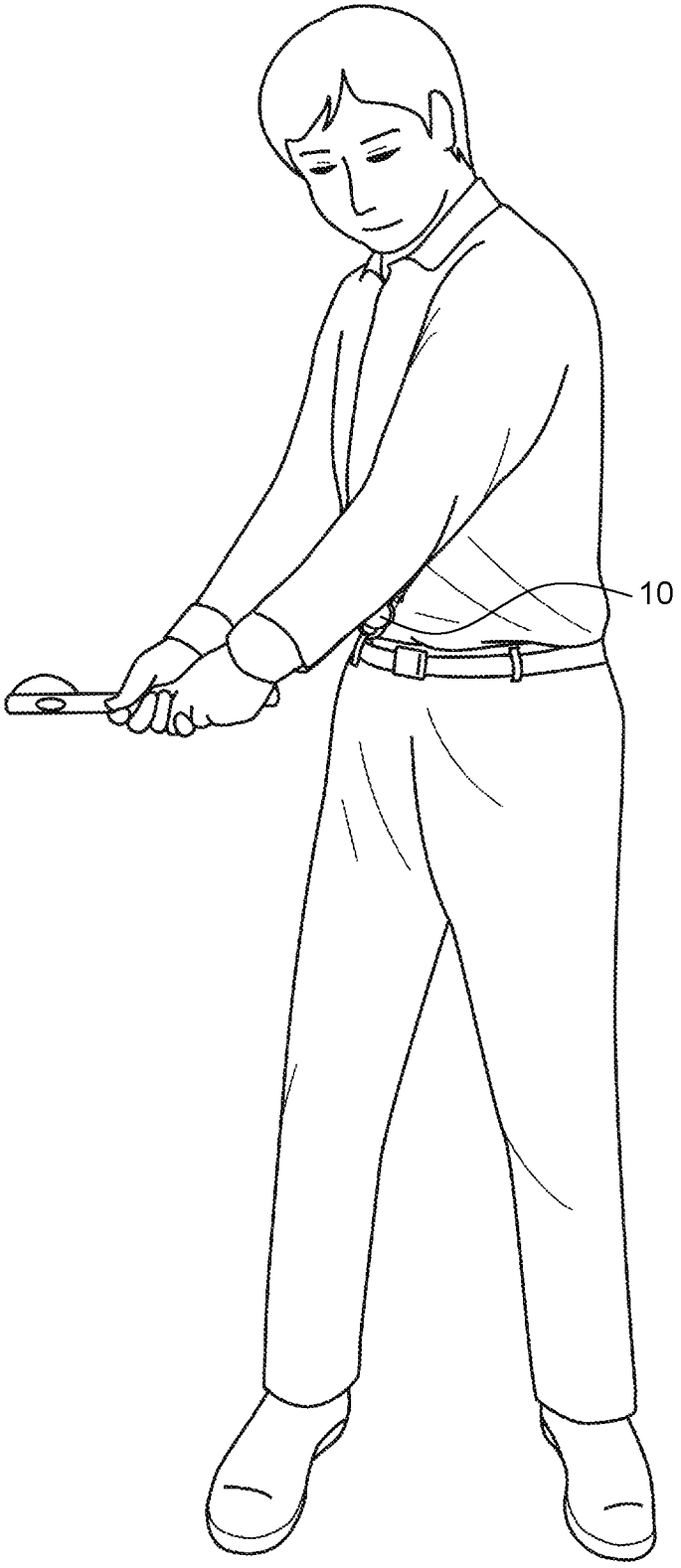
FIG. 8 is a front view for illustrating a state during the takeaway of a practice swing using the golf training apparatus illustrated in FIG. 1.

From the user's stance, the user, keeping the right armpit and the left armpit closed, twists the user's right hip 45° and then the upper body 45° to the right, so that ultimately the upper body faces the opposite direction to the flight direction of the ball. At this time, ideally, the shaft of the golf club points in the opposite direction (the left side in FIG. 8) to the flight direction of the ball (the right side in FIG. 8) and is roughly horizontal (FIG. 8).

In a case in which the right hip has been properly twisted 45° to the right, in this stance, the case 10 attached to the belt loop B of the pants located at a position rotated approximately 45° to the right from the front of the trunk is positioned on the opposite side to the flight direction of the ball. For example, the user can confirm that the right hip is properly twisted just 45° to the right via the user's peripheral vision.

With this, the user can at this stage be aware of the user's state with the user's right armpit and left armpit closed and the first pad 41 kept under the right armpit and the second pad 42 kept under the left armpit.

At this stage, when the user opens up under the right armpit, the first pad 41 would be released from under the right armpit, be pulled by the first string-like member 21 being wound up by the first winding mechanism, and return to a region near the case 10 (the position illustrated in FIG. 5). This would make the user already aware that under the right armpit opened up at this stage. When the first pad 41 returns toward the case 10, the flat coil spring 13 that is in a tightened state becomes suddenly loose. Thus, noise is made by the flat coil spring 13 rubbing against itself and by the moving first pad 41 rubbing against the shirt or coat of the user. Further, in some cases, the first pad 41 may collide with the case 10, making noise and generating a certain impact. When the user hears such noises and feels such an impact, the user can sense that the first pad 41 has returned to a region near the case 10 even if the user is still looking at the ball.

In a similar manner, if the user opens up under the left armpit, the second pad 42 would be released from under the left armpit, be pulled by the second string-like member 22 being wound up by the second winding mechanism, and return to a region near the case 10 (the position illustrated in FIG. 5). This would make the user already aware that under the left armpit opened up at this stage. In a similar manner to the first pad 41, the user can sense that the second pad 42 has returned toward the case 10.

The user can come to know whether or not the form of the swing is correct by not only coming to know whether or not the right hip is properly twisted 45° via the position of the case 10, but also by the timing of when the first pad 41 is released from under the right armpit and the timing of when the second pad 42 is released from under the left armpit. In a case in which, at the stage illustrated in FIG. 8, the first pad 41 is released from under the right armpit or the second pad 42 is released from under the left armpit, the user can confirm that the form of the swing is not proper in terms of the right armpit or the left armpit opening up too early.

In order to allow the user to immediately know the timing of when the first pad 41 is released from the right armpit, it is preferred that the amount of time from when the first pad 41 is released from under the right armpit until when it returns to a region near the case 10 be short. For example, the amount of time is preferably under 1 second. As a matter of course, an even less amount of time is also preferable. This also applies to the amount of time from when the second pad 42 is released from under the left armpit until it returns to a region near the case 10.

Figure 9:
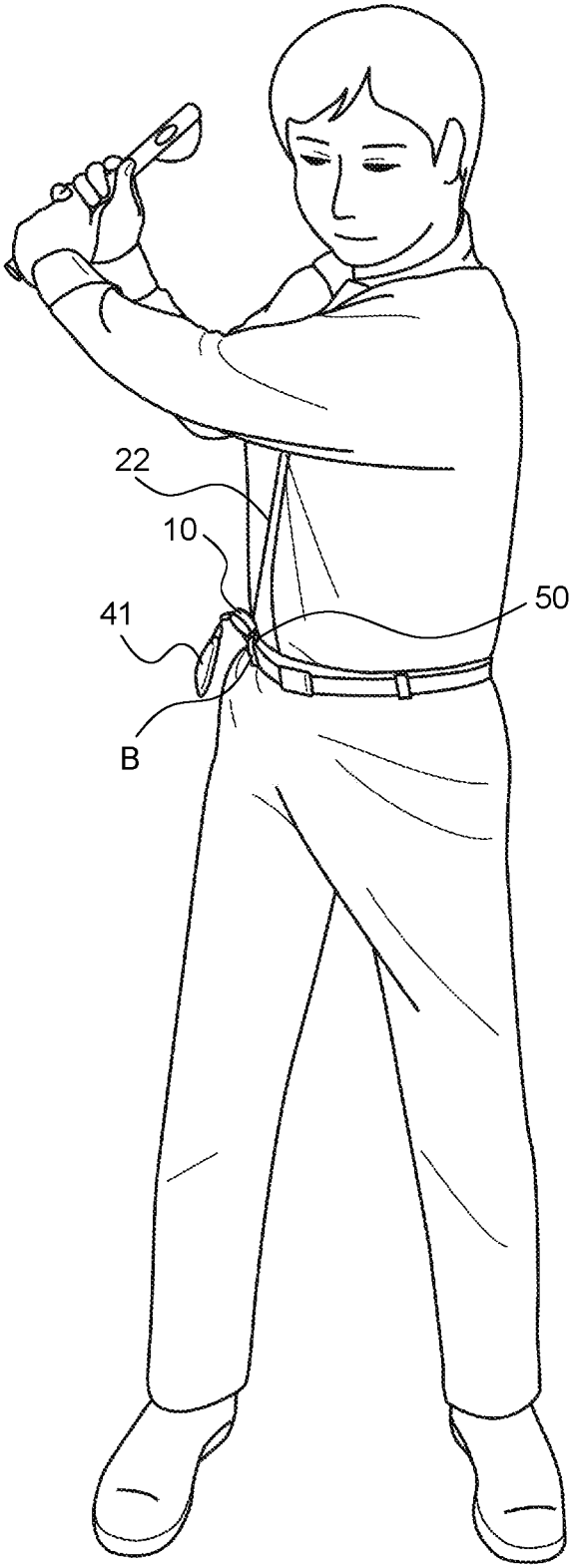
FIG. 9 is a front view for illustrating a state at the top posture of a practice swing using the golf training apparatus illustrated in FIG. 1.

Next, from the state illustrated in FIG. 8, the user raises both hands straight upward, allowing the user to take the top posture with the face (imaginary face) of the golf club remaining in a square state (FIG. 9).

Up until the stage before taking the top posture, the user is in a state with the right armpit and the left armpit closed. Then, the user raises the user's right arm at the stage before taking the top posture. The right arm is raised because if the right armpit remains closed, the golf club will drift inside, the head of the golf club will be offset from the swing plane, and the top posture will be too low. When the right arm is begun to be raised, the right armpit opens. This makes the first pad 41 that is sandwiched under the right armpit be released from under the right armpit. Then, as described above, the first pad 41 returns to a region near the case 10. In FIG. 9, the first pad 41 has already returned to a region near the case 10. The user can easily know that the first pad 41 is released from under the right armpit via the noise and impact generated at this time.

The first pad 41 is released from under the right armpit at this time because the practice swing executed by the user has the proper form, at least up until this stage. In other words, the first pad 41 being released from under the right armpit at this stage indicates that the user held the correct form of keeping the right armpit closed up until just before taking the top posture, that is, that the user held the form without excessively using the user's arm, and that the user made the top posture with the golf club raised without excessively using the user's arm provides assurance of a determination that there is proper trunk rotation. Accordingly, at this stage, the user can confirm that the swing executed up until this point has the proper form from the fact that the first pad 41 has been released from under the right armpit.

The user having taken the top posture illustrated in FIG. 9 now continues and starts the downswing.

When the downswing is executed, while bringing back the right hip and the upper body, leading with the left arm, the right elbow is tucked downward or pulled down, and with the left hip twisted at 45°, an imaginary ball is hit. And the user directs gradually the shaft of the golf club in the flight direction of the ball. At this time, under the left armpit is still closed.

Then, from this state, the user executes the follow through action.

Figure 10:
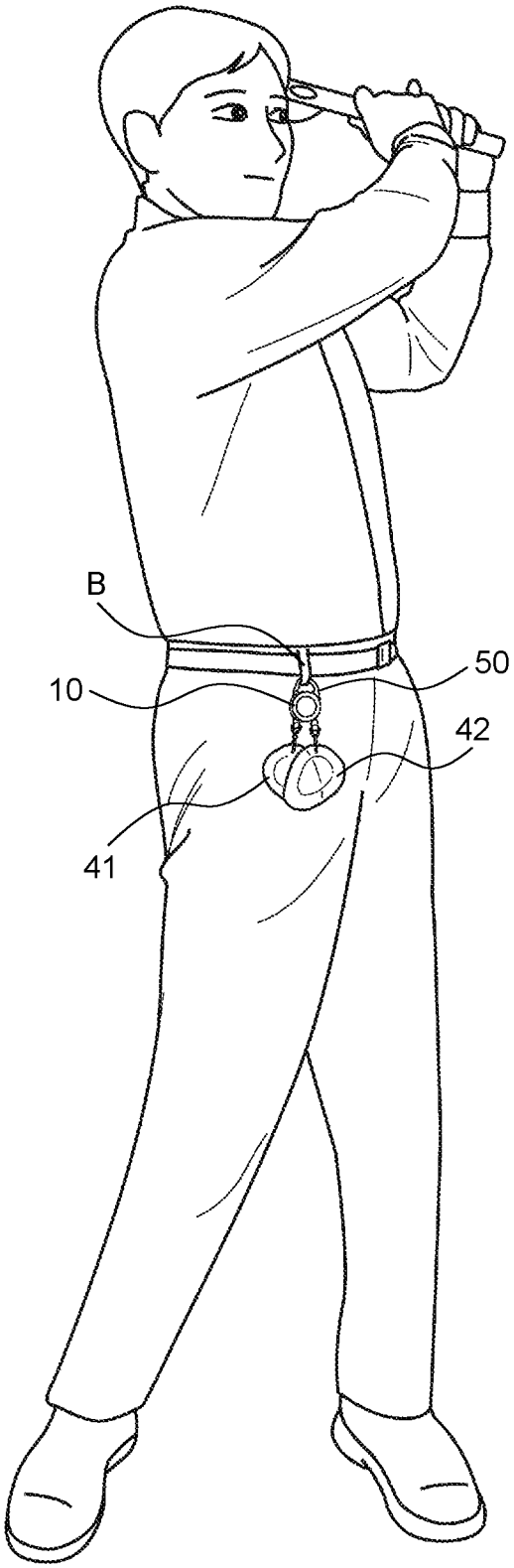
FIG. 10 is a front view for illustrating a state at the finish posture of a practice swing using the golf training apparatus illustrated in FIG. 1.

With the follow through, the user twists the upper body a further 45° in the left direction, making the upper body face the flight direction of the imaginary ball and the left arm rise up. Here, under the left armpit is opened. The user finishes in the finish posture with the upper arm portion of the left arm being roughly horizontal. Thus, just before ending in the finish posture, the second pad 42 that is sandwiched under the left armpit is released from under the left armpit. In FIG. 10, the second pad 42 has already returned to a region near the case 10. The user can easily know that the second pad 42 is released from under the left armpit via the noise and impact generated at this time.

The second pad 42 is released from under the left armpit at this time because the practice swing executed by the user has the proper form from the downswing to the finish action. In other words, the second pad 42 being released from under the left armpit at this stage indicates that the user held the correct form of keeping under the left armpit closed up until just before taking the finish posture, that is, that the user held the form without excessively using the user's arm, and that the user made the finish posture without excessively using the user's arm provides assurance that there is proper trunk rotation. Accordingly, at this stage, the user can confirm that the swing executed from the downswing to the finish has the proper form from the fact that the second pad 42 has been released from under the left armpit.

In this manner, the user can know whether or not the user's practice swing has the proper overall form from the timing of when the first pad 41 is released from under the right armpit and the timing of when the second pad 42 is released from under the left armpit.

By repeating executing a practice swing using the golf training apparatus and correcting the swing until the proper timing for when the first pad 41 is released from under the right armpit and when the second pad 42 is released from under the left armpit is achieved, the user can learn a golf swing with sufficient trunk rotation, that is, not an arms-only golf swing.

Further, the golf training apparatus can be used not only for teaching a user the correct form, but, because the golf training apparatus can be used during a round of golf at the golf course, it can also be used for confirming the current state of the swing during the round, for example.

The uses for the golf training apparatus described above are aimed at teaching the form of a full swing and confirming whether a full swing has the proper form.

However, instead of a full swing, the golf training apparatus can be used to teach and confirm the form of a swing of a half swing of a golf club often used for the short game and the form of a swing when putting using a putter.

Now consideration is made on an example of a 7 o'clock to 5 o'clock swing as seen from the front side of the user assuming that there is face of a large imaginary clock with the waist region of the user as the center behind the user taking stance. With a 7 o'clock to 5 o'clock swing, the shaft of the club, which is vertical when the user takes stance as seen from the front of the user, is inclined backward by approximately 30° at the top posture and inclined forward by approximately 30° at the finish posture. The 7 o'clock to 5 o'clock swing is a fundamental swing used to practice the putter swing. With the proper form, the movement of the putter is stabilized with an isosceles triangle formed by a straight line connecting the shoulders of the user and both arms being maintained. The 7 o'clock to 5 o'clock swing may be used to practice a half swing with a golf club other than the putter.

In the case of executing a 7 o'clock to 5 o'clock swing, it is important to keep under the right armpit and under the left armpit closed from the state of taking stance all the way to finishing in the finish state. The golf training apparatus of the embodiment described above helps this be achieved.

As described above, the golf training apparatus is attached to the front of the waist of the user, for example on the front and right side of the waist of the user, and under this state, the first pad 41 is sandwiched under the right armpit of the user and the second pad 42 is sandwiched under the left armpit of the user. Under this state, the user executes a 7 o'clock to 5 o'clock practice swing. In a case in which neither the first pad 41 nor the second pad 42 is released from under the armpits, the practice swing executed by the user can be said to correspond to the proper form. By making the first pad 41 and the second pad 42 not be released from under the armpits when using the golf training apparatus for training, the user can obtain the proper form.

Next, consideration is made of a similar example of an 8 o'clock to 4 o'clock swing. With an 8 o'clock to 4 o'clock swing, the shaft of the club, which is vertical when the user takes stance as seen from the front of the user, is inclined backward by approximately 60° at the top posture and inclined forward by approximately 60° at the finish posture. The 8 o'clock to 4 o'clock swing is a type of half swing.

In the case of executing an 8 o'clock to 4 o'clock swing also, it is important to keep under the right armpit and under the left armpit closed from the state of taking stance all the way to finishing in the finish state. Thus, as in the putter training example, a practice swing is executed with the first pad 41 sandwiched under the right armpit and the second pad 42 sandwiched under the left armpit. In all steps of the practice swing, in a case in which neither the first pad 41 nor the second pad 42 is released from under the armpits, the practice swing executed by the user can be said to correspond to the proper form.

A 9 o'clock to 3 o'clock swing can also be executed in a similar manner. With a 9 o'clock to 3 o'clock swing, the shaft of the club, which is vertical when the user takes stance as seen from the front of the user, is inclined backward by approximately 90° at the top posture and inclined forward by approximately 90° at the finish posture. The 9 o'clock to 3 o'clock swing is also a type of half swing.

In the case of executing a 9 o'clock to 3 o'clock swing also, it is important to keep under the right armpit and under the left armpit closed from the state of taking stance all the way to finishing in the finish state. Thus, as in the putter training example, a practice swing is executed with the first pad 41 sandwiched under the right armpit and the second pad 42 sandwiched under the left armpit. In all steps of the practice swing, in a case in which neither the first pad 41 nor the second pad 42 is released from under the armpits, the practice swing executed by the user can be said to correspond to the proper form.

In this manner, for example, by repeatedly practicing a 7 o'clock to 5 o'clock swing, an 8 o'clock to 4 o'clock swing, and a 9 o'clock to 3 o'clock swing using the same club, how far the ball flies for each time can be learnt. This allows for different distances to be accurately hit with a single club.

When the golf training apparatus is no longer required, the user removes the golf training apparatus from the user's garment. In the case the attachment member 50 is a carabiner, the golf training apparatus can be detached from the pants of the user by pushing the movable member 52 toward the base end of the bowed member 51, forming a gap between the distal end of the movable member 52 and the distal end of the bowed member 51, and removing the belt loop B of the pants from the gap.

The invention claimed is:

1. A golf training apparatus, comprising:

an attachment member configured to be detachably attached to a front side of a waist of a user;

a case to which the attachment member is attached;

a first windable member including a first base end housed in the case, the first windable member having a first wind-up force in a direction toward the first base end constantly applied thereto from a first winding mechanism provided in the case and being configured to be pulled out from the case against the first wind-up force from the first winding mechanism;

a first pad provided on a distal end of the first windable member, the first pad having a size and shape that enables the user to sandwich the first pad under one armpit;

a first connection member disposed on the distal end of the first windable member and attached to the first pad;

a second windable member including a second base end housed in the case, the second windable member having a second wind-up force in a direction toward the second base end constantly applied thereto from a second winding mechanism provided in the case and being configured to be pulled out from the case against the second wind-up force from the second winding mechanism;

a second pad provided on a distal end of the second windable member, the second pad having a size and shape that enables the user to sandwich the second pad under another armpit, a second connection member disposed on the distal end of the second windable member and attached to the second pad, wherein when the first windable member is wound up by the first winding mechanism and the first connection member collides with the case, a first noise perceivable by the user and a first impact are generated, and wherein when the second windable member is wound up by the second winding mechanism and the second connection member collides with the case, a second noise perceivable by the user and a second impact are generated.

2. The golf training apparatus according to claim 1, wherein the first pad and the second pad each include a first surface that is a convex surface and a second surface on a side opposite to the first surface, wherein the second surface is flat.

3. The golf training apparatus according to claim 1, wherein the first pad and the second pad are made of an elastic material.

4. The golf training apparatus according to claim 1, wherein the first pad and the second pad each have a shape on a distal end side that is tapered and rounded.

5. The golf training apparatus according to claim 1, wherein the first pad and the second pad are colorless and transparent or colorless and semitransparent.

6. The golf training apparatus according to claim 5, wherein the first pad and the second pad are made of an elastic material comprising at least one of silicone rubber or urethane rubber.

7. The golf training apparatus according to claim 1, wherein the attachment member is configured to be detachably attached to a belt loop of pants worn by a user.

8. The golf training apparatus according to claim 1, wherein the case includes:

a first opening provided in the case for the first windable member to pass through the case; and a second opening provided in the case for the second windable member to pass through the case, and wherein the first opening and the second opening and the attachment member are located at positions on opposite sides of the case.

9. The golf training apparatus according to claim 1, wherein the first wind-up force of the first winding mechanism pulls the first connection member against the case when no force against the first wind-up force of the first winding mechanism is applied, and wherein the second wind-up force of the second winding mechanism pulls the second connection member against the case when no force against the second wind-up force of the second winding mechanism is applied.

10. The golf training apparatus according to claim 1, wherein the first connection member comprises a first connection fitting attached to the first pad, and the second connection member comprises a second connection fitting attached to the second pad.

11. The golf training apparatus according to claim 1, further comprising a first guide portion disposed inside the case, wherein the first guide portion has a smooth curved surface over which the first windable member is guided between a first hole through the case and the first winding mechanism.

12. The golf training apparatus according to claim 11, further comprising a second guide portion disposed inside the case, wherein the second guide portion has a smooth curved surface over which the second windable member is guided between a second hole through the case and the second winding mechanism.

13. The golf training apparatus according to claim 12, wherein the first winding mechanism and the second winding mechanism are disposed overlapping one another in a thickness direction of the case.

14. The golf training apparatus according to claim 13, wherein the first winding mechanism has a mirror image relationship with the second winding mechanism.

15. The golf training apparatus according to claim 14, wherein the first hole and the first guide portion have a mirror image relationship with the second hole and the second guide portion, respectively.

16. The golf training apparatus according to claim 15, further comprising a first cylindrical member attached to the case and defining the first hole through which the first windable member runs inside and outside the case, and a second cylindrical member attached to the case and defining the second hole through which the second windable member runs inside and outside of the case.

17. The golf training apparatus according to claim 16, wherein the first hole has a size large enough to allow the first windable member to run through the first hole, and small enough to prevent the first connection member from entering the first hole.

18. A golf training apparatus, comprising:

an attachment member configured to be detachably attached to a front side of a waist of a user;

a case to which the attachment member is attached;

a first winding member disposed in the case;

a first windable member including a first base end attached to the first winding member, wherein the first winding member constantly applies to the first windable member a first wind-up force in a direction toward the first base end of the first windable member;

a first pad connected to a distal end of the first windable member opposite to the first base end, the first pad having a size and shape that enables the user to sandwich the first pad under one armpit, wherein the first pad is connected to the distal end either directly or with a first connection member;

a second winding member disposed in the case;

a second windable member including a second base end attached to the second winding member, wherein the second winding member constantly applies to the second windable member a second wind-up force in a direction toward the second base end of the second windable member; and a second pad connected to a distal end of the second windable member opposite to the second base end, the second pad having a size and shape that enables the user to sandwich the second pad under another armpit, wherein the second pad is connected to the distal end either directly or with a second connection member, wherein when the first windable member is wound up by the first winding mechanism and either the first pad or the first connection member collides with the case, a first noise perceivable by the user and a first impact are generated, and wherein when the second windable member is wound up by the second winding mechanism and either the second pad or the second connection member collides with the case, a second noise perceivable by the user and a second impact are generated.

* * * * *